US005503308A

United States Patent [19]

Young et al.

[11] Patent Number: 5,503,308

[45] Date of Patent: Apr. 2, 1996

[54] PLASTIC BLOW MOLDED BOTTLE HAVING BELLOWS SUPPORTED DISPENSING SPOUT

[75] Inventors: William C. Young, Superior Township, Washtenaw County; William A. Slat, Brooklyn, both of Mich.; Richard C. Darr, Seville, Ohio

[73] Assignee: Plastipak Packaging, Inc., Plymouth, Mich.

[21] Appl. No.: 326,123

[22] Filed: Oct. 19, 1994

[51] Int. Cl.[6] ..... B67D 3/00

[52] U.S. Cl. ..... 222/529

[58] Field of Search ..... 222/527, 529, 222/530, 538, 541.6

[56] References Cited

U.S. PATENT DOCUMENTS

| | | | |
|---|---|---|---|
| 4,027,811 | 6/1977 | Chlystun | 222/529 |
| 4,236,655 | 12/1980 | Humphries | 222/530 |
| 4,351,454 | 9/1982 | Maynard, Jr. | 222/529 |
| 4,492,324 | 1/1985 | Weber | 222/529 |
| 4,602,728 | 7/1986 | Hg | 222/530 |
| 4,856,664 | 8/1989 | Gillispie et al. | 222/529 |
| 5,065,914 | 11/1991 | Chollet | 222/529 |
| 5,078,286 | 1/1992 | Hashimoto | 215/229 |
| 5,133,481 | 7/1992 | Mayfield | 222/530 |
| 5,170,910 | 12/1992 | Hamm | 222/527 |

*Primary Examiner*—Andres Kashnikow
*Assistant Examiner*—Philippe Derakshani
*Attorney, Agent, or Firm*—Brooks & Kushman

[57] ABSTRACT

A plastic blow molded bottle (20*a*,20*b*,20*c*,20*d*) has an upper dispensing end (32) including an upper wall (34) and a generally wedge-shaped bellows (36) that supports a dispensing spout (38) on the upper wall initially vertical for filling and shipping of the bottle. The dispensing spout (38) is tilted as the generally wedge-shaped bellows (36) contracts to allow more convenient dispensing. A frangible connection (40) that initially supports the dispensing spout (38) vertically is broken to allow the dispensing spout tilting for the dispensing. The frangible connection (40) includes a tab (48) having a reduced thickness portion (50) where it is broken, preferably at connection thereof to the upper wall (34) and the dispensing spout (38) such that the tab is removable from the bottle. An inclined wall portion provided by one inclined end (41) of a horizontally elongated gable shape of the upper wall (34) mounts the generally wedge-shaped bellows (36) to support the dispensing spout (38).

20 Claims, 5 Drawing Sheets

Fig. 1
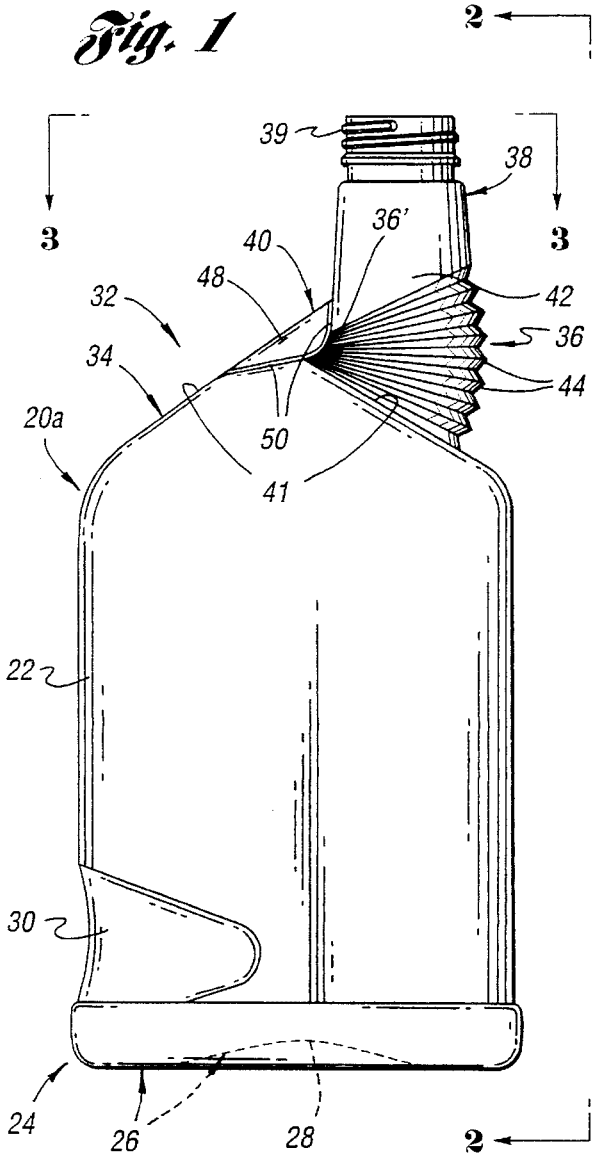
Fig. 2
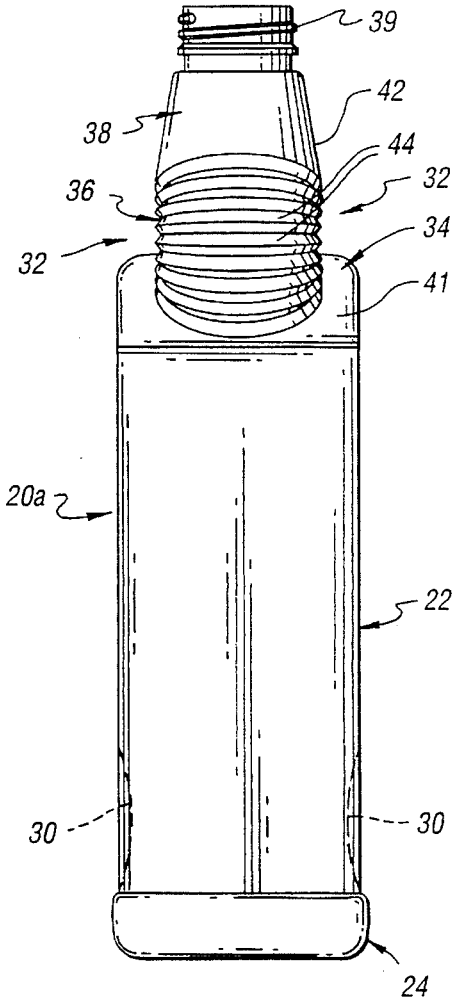
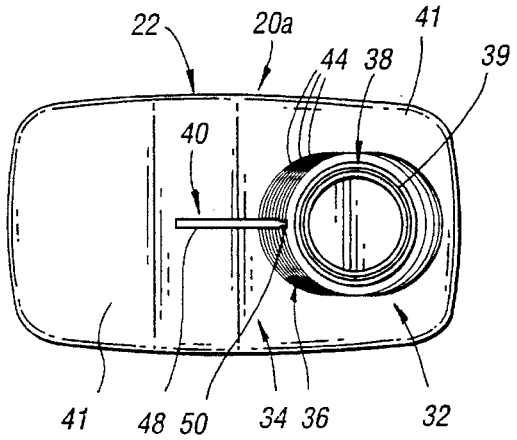
Fig. 3

Fig. 4
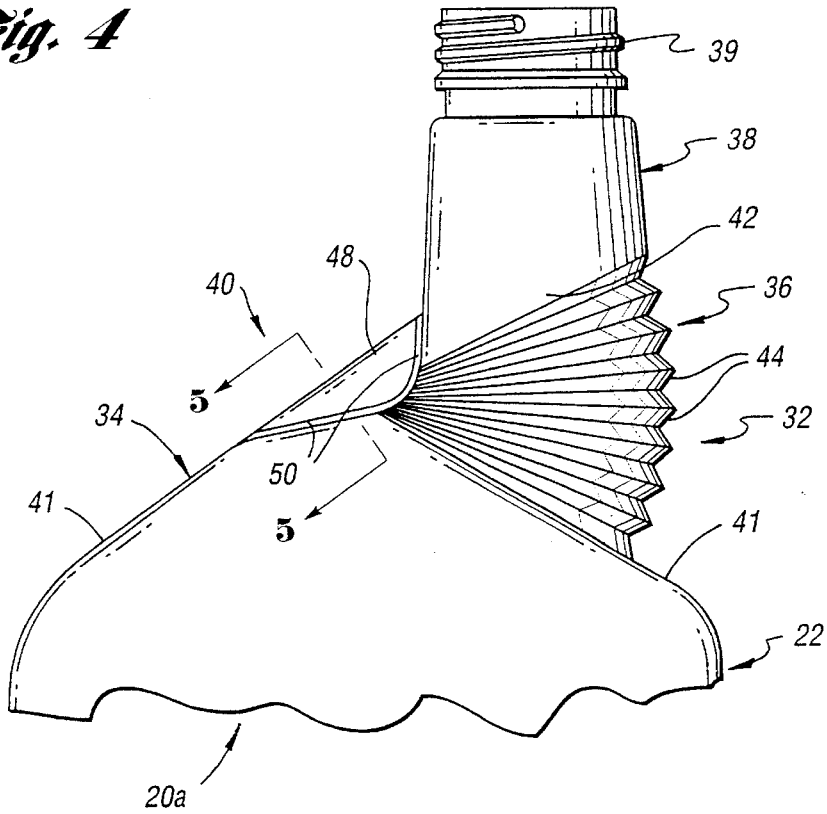
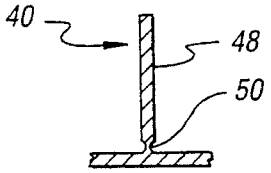
Fig. 5
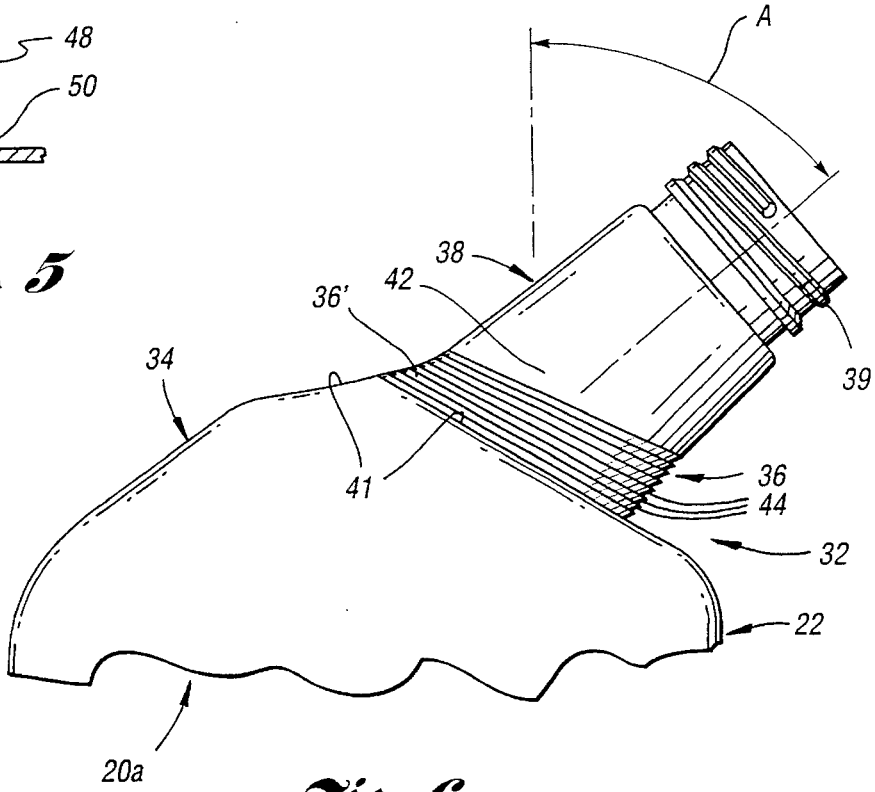
Fig. 6

Fig. 7
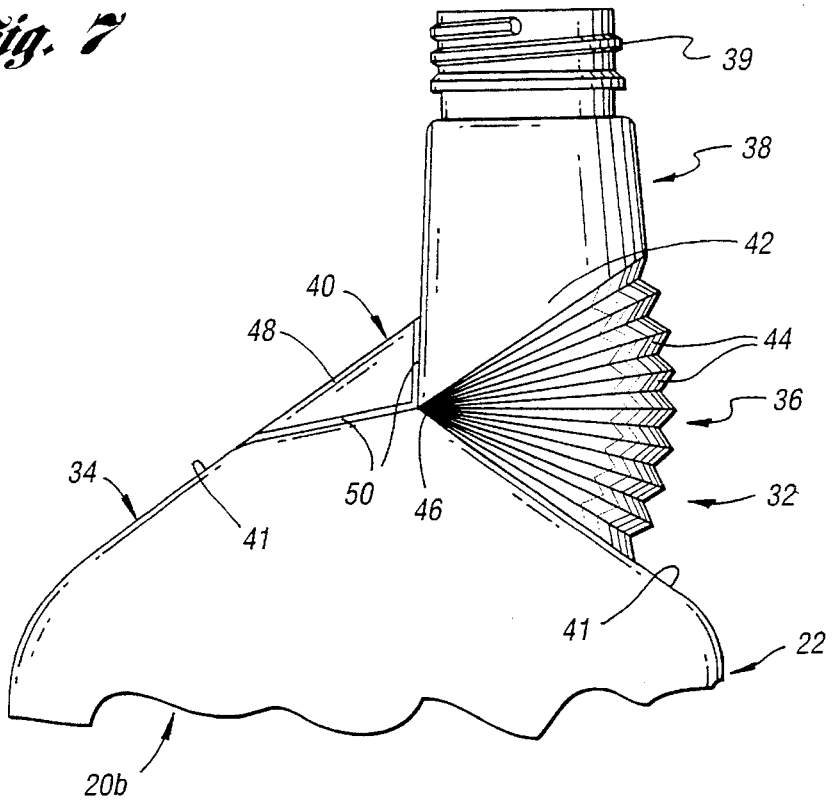
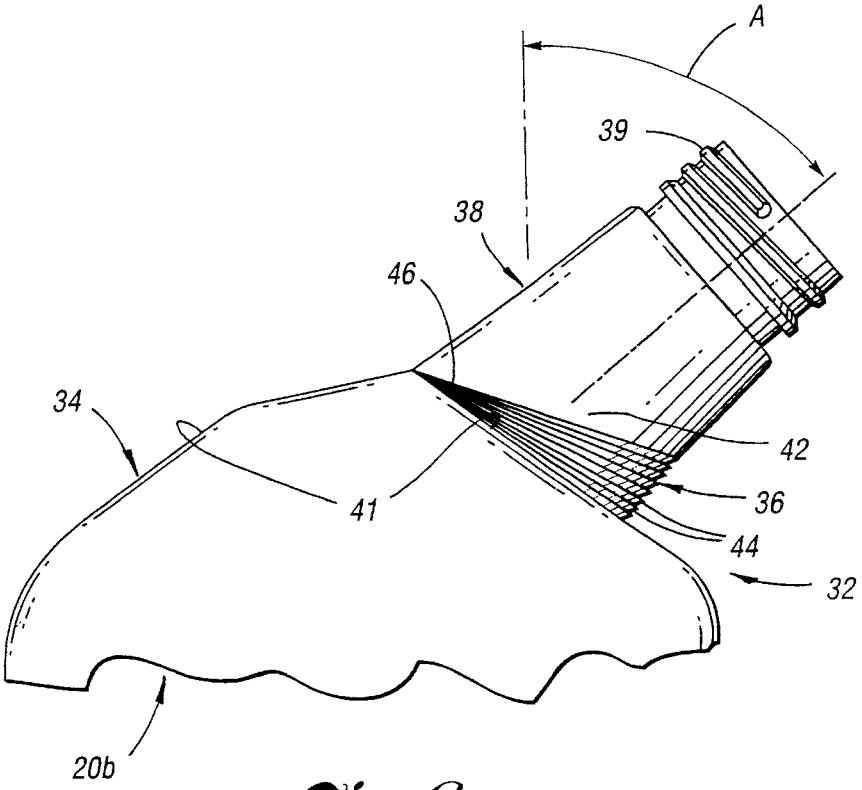
Fig. 8

Fig. 9
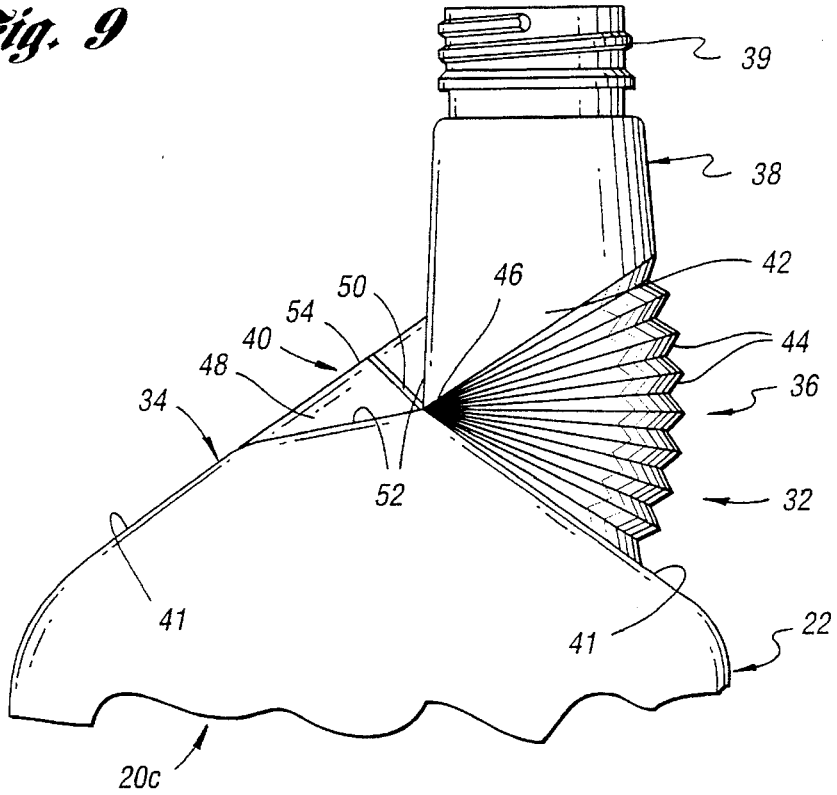
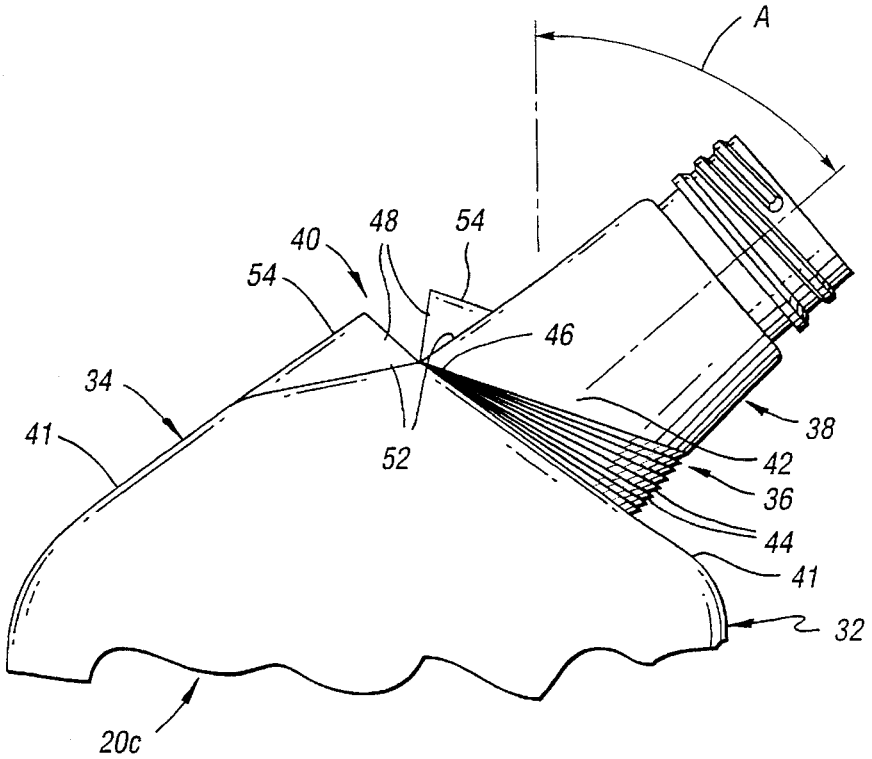
Fig. 10

Fig. 11
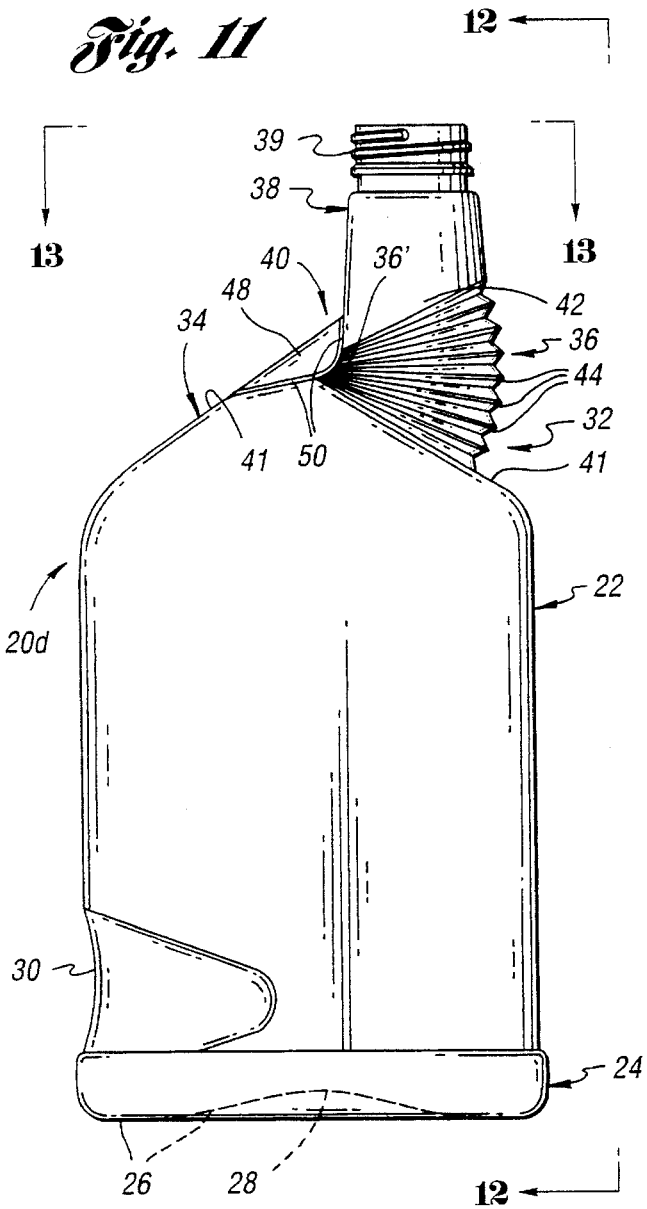
Fig. 12
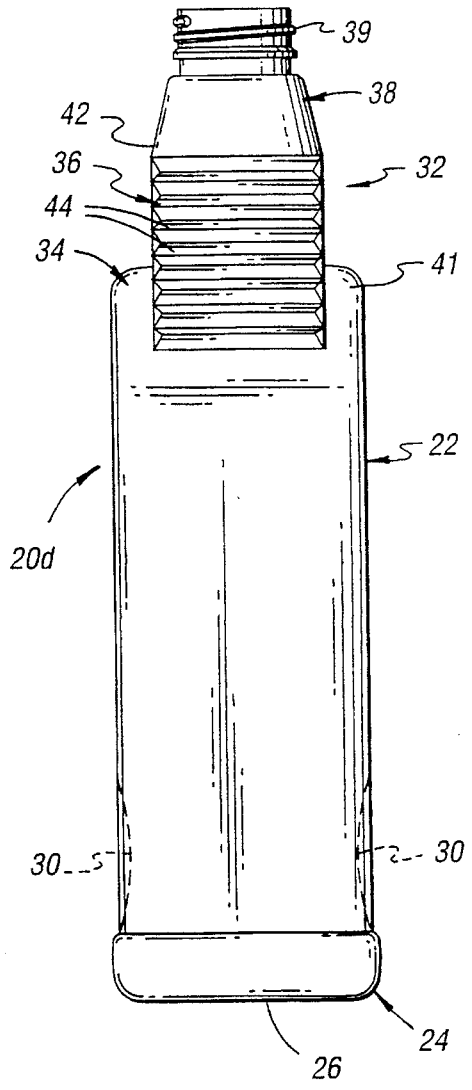
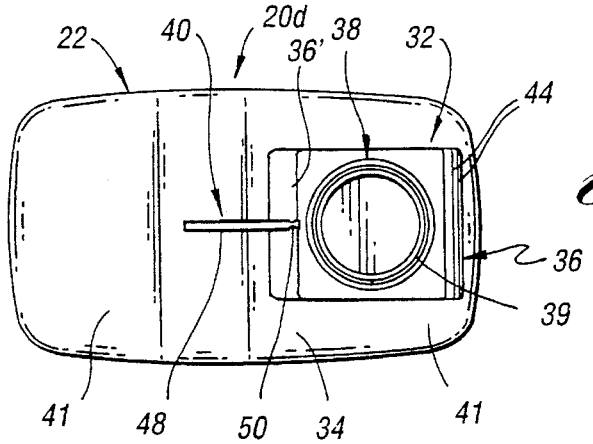
Fig. 13

PLASTIC BLOW MOLDED BOTTLE HAVING BELLOWS SUPPORTED DISPENSING SPOUT

TECHNICAL FIELD

This invention relates to an improved plastic blow molded bottle having an upper dispensing spout and has particular utility for use as a motor oil bottle.

BACKGROUND ART

In the past, motor oil was packaged in containers including treated paperboard sleeves whose upper and lower ends were closed by sheet metal lids. Dispensing of the motor oil with such containers requires a can opener or another tool such as a punch for providing a pair of holes in the upper lid generally at diametrically opposite locations, such that tilting of the container causes the motor oil to pour out of one hole while the other hole functions as an air vent.

Plastic blow molded bottles have substantially replaced treated paperboard sleeve/metal lid containers for motor oil. Such plastic blow molded bottles have a vertically extending body portion whose lower extremity is closed by a lower wall and whose upper extremity supports an upper dispensing end having a dispensing spout with a thread for receiving a threaded closure cap. As such, there is advantageously no need for a can opener or other tool for dispensing of motor oil from such plastic blow molded bottles.

Initially, plastic blow molded bottles for motor oil had a centrally located dispensing spout on the upper dispensing end above a body portion with either a round or a horizontally elongated rectangular shape when viewed in a vertical direction. More recently, plastic blow molded bottles for motor oil have included a dispensing spout located above an elongated rectangularly shaped body portion adjacent one end of the body portion. This type of bottle is intended to dispense the motor oil by tilting the bottle along its elongated direction with the dispensing spout end located above the other end so as to facilitate pouring of the oil into an oil intake such as an engine crankcase oil fill opening. However, most consumers actually use such bottles in the opposite orientation, specifically with the dispensing spout end of the elongated upper dispensing end located below the other end thereof rather above as intended.

Prior art references noted by an investigation conducted in connection with the present invention are described below.

U.S. Pat. No. 5,078,286 Hashimoto discloses a beverage container having a vertical straw member that extends along the side of the container. A lower end of the straw member is mounted by a lower side portion of the container and includes a flexible bellows of a vertically elongated shape. An upper end of the straw member has a thinned portion that positions the straw member but is broken to release the straw member for flexing of the elongated bellows and positioning of the straw member for consumption of the beverage.

U.S. Pat. Nos. 4,027,811 Chlystun and 4,492,324 Weber disclose containers having dispensing spouts that are mounted by flexible bellows and that have provisions for securing the dispensing spouts with respect to the container during shipping and storage prior to use.

Other containers having dispensing spouts supported by flexible bellows are disclosed by U.S. Pat. Nos. 4,351,454 Maynard, Jr. and 4,856,664 Gillespie et al. Also, U.S. Pat. No. 5,065,914 Chollet discloses a thermoplastic container having a pouring tube mounted by two recessed pyramids for movement between stored and use positions.

DISCLOSURE OF INVENTION

An object of the present invention is to provide a plastic blow molded bottle having an improved bellows supported dispensing spout for facilitating dispensing of the bottle contents and has particular utility when used for motor oil.

In carrying out the above object and other objects of the invention, a plastic blow molded bottle includes a vertically extending body portion for holding contents received by the bottle. A lower closure end of the bottle includes a lower wall that closes the lower extremity of the body portion. An upper dispensing end of the bottle includes an upper wall that generally closes the upper extremity of the body portion. A generally wedge-shaped bellows of the upper dispensing end is mounted by the upper wall. A dispensing spout of the upper dispensing end is mounted by the generally wedge-shaped bellows on the upper wall in a generally vertical position for filling of the bottle but is tiltable as the bellows contracts to allow more convenient dispensing of the bottle contents.

Different embodiments are disclosed for supporting the dispensing spout. In one construction, the dispensing spout has a lower end that is entirely supported by the generally wedge-shaped bellows which is truncated and has folds that extend angularly with respect to each other away from the location of truncation. In another construction, the dispensing spout has a lower end including a pivotal connection to the upper wall, and the generally wedge-shaped bellows includes folds that extend angularly with respect to each other away from the pivotal connection.

The bottle includes a frangible connection that extends between the dispensing spout and the upper wall to position the dispensing spout generally vertical for filling of the bottle. The frangible connection is broken to allow the tilting of the dispensing spout as the bellows contracts to allow more convenient dispensing of the bottle contents. The frangible connection preferably includes a tab that extends between the dispensing spout and the upper wall and that is broken to release the dispensing spout for the tilting. This tab preferably includes a reduced thickness portion that facilitates fracturing thereof to release the dispensing spout for the tilting.

In one construction, the reduced thickness portion of the tab of the frangible connection is disclosed as connecting the tab to the dispensing spout, and the reduced thickness portion is also disclosed as connecting the tab to the upper wall. The connection of the reduced thickness portion of the tab to both the dispensing spout and the upper wall facilitates the tab in being broken away from the bottle to release the dispensing spout for its tilting.

In another construction, the tab of the frangible connection includes an inner portion connected to both the upper wall and the dispensing spout and also includes an outer edge portion. The reduced thickness portion of the frangible connection extends between the inner portion and the outer edge portion. With this construction as in other possible constructions, the tab of the frangible connection includes at least a portion that remains secured to the bottle after the fracturing thereof for tilting of the dispensing spout.

Different constructions of the dispensing spout of the plastic blow molded bottle are disclosed. In one construction, the bellows has folds that are rounded and that extend angularly with respect to each other to provide the generally wedge shape of the bellows. In another construction, the bellows has folds that are generally rectangular and that extend angularly with respect to each other to provide the generally wedge shape of the bellows.

The upper wall portion of the upper dispensing end has a wall portion that is inclined downwardly in an outward direction with respect to a central axis of the bottle and that supports the lower extremity of the generally wedge-shaped bellows. The dispensing spout has a lower end that is inclined upwardly in an outward direction with respect to the central vertical axis of the bottle and that is supported by the upper extremity of the generally wedge-shaped bellows, such that the dispensing spout is supported initially upright for filling and shipping as well as storage, and the dispensing spout is then tilted after breaking the frangible connection for dispensing of the bottle contents with the bellows contracted.

The body portion, the lower closure end and the upper dispensing end have a horizontally elongated shape with opposite ends. The generally wedge-shaped bellows is mounted on the upper wall of the horizontally elongated upper dispensing end at one end thereof with the dispensing spout mounted by the bellows. The upper wall preferably has opposite ends inclined downwardly away from each other in a generally gable shape with the lower extremity of the generally wedge-shaped bellows mounted on one of the inclined ends of the upper wall. The dispensing spout has a lower end that is inclined upwardly in an outward direction with respect to the peak of the gable shape of the upper wall and that is supported by the upper extremity of the generally wedge-shaped bellows.

The objects, features and advantages of the present invention are readily apparent from the following detailed description of the best modes for carrying out the invention when taken in connection with the accompanying drawings.

BRIEF DESCRIPTION OF DRAWINGS

FIG. 1 is a side elevational view of a plastic blow molded bottle that includes a bellows mounted dispensing spout constructed in accordance with the present invention;

FIG. 2 is an end elevational view of the bottle taken along the direction of line 2—2 in FIG. 1;

FIG. 3 is a top plan view of the bottle taken along the direction of line 3—3 in FIG. 1;

FIG. 4 is a partial view of the upper dispensing end of the bottle taken in the same direction as FIG. 1 but on an enlarged scale;

FIG. 5 is a partial sectional view of the bottle taken on an enlarged scale through a tab of a frangible connection along the direction of line 5—5 in FIG. 4;

FIG. 6 is a partial view of the bottle similar to FIG. 4 but shown with the frangible connection broken by removal of the tab to permit the tilting of the dispensing spout which is entirely supported by the generally wedge-shaped bellows;

FIG. 7 is a partial view similar to FIG. 4 of another embodiment of the bottle wherein the dispensing spout has a lower end including a pivotal connection to the upper wall;

FIG. 8 is a partial view of the bottle similar to FIG. 7 but after the frangible connection has been broken by the removal of the tab to permit the tilting of the dispensing spout;

FIG. 9 is a partial view similar to FIG. 7 but illustrating another embodiment of the bottle wherein the tab of the frangible connection has a reduced thickness portion that extends between an inner portion and an outer edge portion thereof;

FIG. 10 is a partial view of the bottle similar to FIG. 9 but after the tab of the frangible connection has been broken so as to permit the tilting of the dispensing spout;

FIG. 11 is a view similar to FIG. 1 but illustrating another embodiment of the plastic blow molded bottle wherein the dispensing spout and the wedge-shaped bellows extend vertically with rectangular shapes rather than rounded shapes;

FIG. 12 is an end elevational view of the bottle taken along the direction of line 12—12 in FIG. 11; and FIG. 13 is a top plan view of the bottle taken along the direction of line 13—13 in FIG. 11.

BEST MODES FOR CARRYING OUT THE INVENTION

Different embodiments of plastic blow molded bottle constructed in accordance with the present invention are identified by reference numeral 20*a* in FIGS. 1–6, 20*b* in FIGS. 7 and 8, 20*c* in FIGS. 9 and 10, and 20*d* in FIGS. 11–13. Each embodiment of the plastic blow molded bottle has a vertically extending body portion 22 for holding contents received by the bottle which has particular utility for use in holding motor oil as is hereinafter more fully described. A lower end closure 24 of the bottle includes a lower wall 26 that closes the lower extremity of the body portion 22 and as illustrated has an upwardly extending central potion 28 so that the bottle is supported by its periphery without rocking. Adjacent the lower end closure, the lower extremity of the body portion 22 includes a contoured formation 30 for facilitating holding of the bottle during dispensing of its contents.

Each embodiment of the bottle includes an upper dispensing end 32 including an upper wall 34 that generally closes the upper extremity of the body portion 22. A generally wedge-shaped bellows 36 of the upper dispensing end 32 is mounted by the upper wall. A dispensing spout 38 of the upper dispensing end 32 is mounted by the generally wedge-shaped bellows 36 on the upper wall and has a retainer preferably embodied by a thread 39 for securing an unshown threaded closure cap. The dispensing spout 38 is mounted in a generally vertical position as shown in FIGS. 1, 2, 4, 7, 9, 11 and 12 for filling of the bottle. The dispensing spout 38 is also tiltable as shown in FIGS. 6, 8 and 10 as the generally wedge-shaped bellows 36 contracts to allow more convenient dispensing of the bottle contents.

A frangible connection 40 of the upper dispensing end 32 extends between the dispensing spout 38 and the upper wall 34 to position the dispensing spout generally vertical for filling of the bottle. This frangible connection 40 is broken to allow the dispensing spout to be tilted as shown by curved arrow A in FIGS. 6, 8 and 10 while the generally wedge-shaped bellows 36 contracts, and the tilting allows more convenient dispensing of the bottle contents as it is tipped to pour the contents from the dispensing spout.

Each embodiment of the bottle as best illustrated in FIG. 3 has a horizontally elongated shape such that the body portion 22, the lower end closure 24 and the upper dispensing end 32 are horizontally elongated. The upper wall 34 of the elongated upper dispensing end 32 has opposite ends 41 and the generally wedge-shaped bellows 36 is mounted on the upper wall 34 of the elongated upper dispensing end 32 at one of the wall ends 41. Furthermore, the upper wall ends 41 are preferably inclined downwardly in an outward direction away from a central vertical axis of the bottle and away from each other in a generally gable shape whose peak is located generally adjacent the central vertical axis of the bottle. The generally wedge-shaped bellows 36 of each embodiment points horizontally in an inward direction with respect to the bottle and is mounted on a wall portion provided by one of the wall ends 41 which is inclined downwardly in an outward direction with respect to the central vertical axis of the bottle. The dispensing spout 38 has a lower end 42 that is inclined upwardly in an outward direction away from the central axis of the bottle where the upper wall gable peak is located. This inclination of the wall portion provided by the one wall end 41 and the inclination of the lower end 42 of the dispensing spout 38 permits the generally wedge-shaped bellows 36 to tilt the dispensing spout with a relatively large inclination from the vertical, e.g. about 45°–55° as shown in FIGS. 6, 8 and 10, without constricting the flow through the bellows. Each bottle embodiment also has the upper extremity of its generally wedge-shaped bellows inclined from the horizontal approximately the same angular extent as its lower extremity to provide the horizontally pointing orientation that is inwardly toward the central vertical axis of the bottle.

The bottle 20*a* shown in FIGS. 1–6 and the bottle 20*d* shown in FIGS. 11–13 each has its dispensing spout 38 provided with a lower end 42 that is entirely supported by the generally wedge-shaped bellows 36. The generally wedge-shaped bellows 36 is slightly truncated and has folds 44 that extend angularly from each other away from the location of truncation 36'. Upon breaking the frangible connection 40 for tilting of the dispensing spout 38, the bellows folds 44 are compressed to a greater extent on the right side thereof than on the left side thereof as illustrated in FIGS. 4 and 6. This truncated construction of the generally wedge-shaped bellows 36 allows a relatively large extent of tilting of the dispensing spout 38, e.g. an included angle of about 55° between the upper and lower extremities of the truncated bellows 36 permits tilting of dispensing spout from the upright position about 50° to the tilted position shown in FIG. 6. This is possible since each bellows fold 44 contracts about its own effective axis of tilting such that the upper and lower extremities of the bellows 36 can be contracted to almost a parallel relationship to each other in the tilted position of the dispensing spout 38.

The embodiments of the plastic blow molded bottle 20*b* and 20*c* respectively illustrated by FIGS. 7 and 8 and by FIGS. 9 and 10 have a dispensing spout 38 whose lower end 42 has a pivotal connection 46 to the upper wall 34. The generally wedge-shaped bellows 36 has its folds 44 extending angularly with respect to each other away from the pivotal connection 46. Upon breaking of the frangible connection 40 for either the bottle 20*b* shown in FIG. 7 or the bottle 20*c* shown in FIG. 9, the right extremity of the generally wedge-shaped bellows 36 has its folds 44 moved closer to each other as illustrated by the bellows contraction shown in FIGS. 8 and 10 for the respective embodiments. This pointed construction of the generally wedge-shaped bellows 36 is illustrated as having an included angle slightly less than 70° between its upper and lower extremities with the dispensing spout 38 upright and allows tilting of about 50° to the tilted position shown in FIGS. 8 and 10 where the included angle of the bellows between its upper and lower extremities is just slightly less than 20°.

Each of the bottle embodiments 20*a*, 20*b*, 20*c* and 20*d* has its frangible connection 40 constructed to include a tab 48 that extends between the dispensing spout 38 and the upper wall 34 so as to thereby vertically position the dispensing spout during filling of the bottle with its contents such as with motor oil for which the bottle has particular utility. Breakage of the tab 48, as is hereinafter more fully described in connection with each of the embodiments, causes the frangible connection 40 to release the dispensing spout 38 so that it can be tilted as previously described upon contraction of the generally wedge-shaped bellows 36. As previously mentioned, this tilting of the dispensing spout 38 facilitates pouring of the bottle contents as the bottle is tipped and the construction disclosed also provides the pouring without restricting the flow at the bellows 36.

Each of the embodiments of the frangible connection tab 48 has a generally uniform thickness but also has a reduced thickness portion 50 such as illustrated in FIG. 5 in connection with the bottle embodiment 20*a*. This reduced thickness portion can be conveniently manufactured by a mold pinch line that is slightly spaced. The reduced thickness portion 50 facilitates fracturing of the frangible connection tab 48 to release the dispensing spout 38 for the tilting as previously described. The bottle embodiments 20*a*, 20*b*, and 20*d* each have the reduced thickness portion 50 connecting the frangible connection tab 48 to the dispensing spout 38 adjacent its lower end 42 at the central side thereof, and the reduced thickness portion 50 of these embodiments also connects the frangible connection tab 48 to the upper wall 34 adjacent the peak of its generally gable configuration. In addition, the bottle embodiment 20*a* shown in FIGS. 1–6 and the bottle embodiment 20*d* shown in FIGS. 11–13 also has the reduced thickness portion 50 connecting the frangible connection tab 48 to the generally wedge-shaped bellows 36 adjacent its slightly truncated central side. With each of the bottle embodiments 20*a*, 20*b*, and 20*d*, the frangible connection tab 48 can be easily manually removed due to the manner in which the reduced thickness portion 50 thereof provides the entire securement thereof to the bottle. Such removal of the tab 48 upon fracturing of the frangible connection 40 thus permits the tilting of the dispensing spout 38 for the dispensing of the bottle contents without leaving any producing portion from the dispensing spout or the adjacent portion of the upper wall.

With reference to FIGS. 9 and 10, this embodiment of the bottle 20*c* has the tab 48 of the frangible connection 40 provided with an inner portion 52 connected to both the dispensing spout 38 adjacent its lower end 42 at the central side thereof and to the upper wall 34 adjacent the peak of its generally gable shaped configuration. The tab 48 of the frangible connection 40 also includes an outer edge portion 54 that extends between the dispensing spout 38 and the upper wall 34 to provide the tab 48 with a triangular shape. The reduced thickness portion 50 of this frangible connection tab 48 extends between the inner portion 52 thereof and the outer edge portion 54 and is broken as illustrated in FIG. 10 to release the dispensing spout for the tilting as the generally wedge-shaped bellows 36 contracts as previously described. Thus, the broken portions of this frangible connection tab 48 remain secured to the dispensing spout 38 and the upper wall 34 with the dispensing spout tilting. The reduced thickness portion 50 as illustrated extends away from the inner portion 52 at the pivotal connection 46 of the dispensing spout 38 to the upper wall 34.

It should be appreciated that it is more preferable for the frangible connection tab 48 to be entirely removed from the bottle as illustrated with the bottle embodiments 20*a*, 20*b*, and 20*d* so that the bottle does not have any protrusion adjacent the dispensing spout as the bottle contents are dispensed. However, it is possible to utilize a frangible connection in which tab portions remain secured thereto as described above in connection with the bottle embodiment 20*c*. Furthermore, although not illustrated, it is also possible for the reduced thickness portion to connect the frangible connection tab 48 only to the dispensing spout 38 or only to the upper wall 34 such that release thereof from the associated bottle component allows the dispensing spout tilting with the tab remaining connected to the bottle component. However, as mentioned above, it is preferred for the tab 48 to be fully removed from the bottle during the dispensing.

The bottle embodiment 20*a* shown in FIGS. 1–6, the bottle embodiment 20*b* shown in FIGS. 7 and 8, and the bottle embodiment 20*c* shown in FIGS. 9 and 10 each has its bellows 36 constructed with folds 44 that are rounded as best illustrated in FIGS. 2 and 3 and that extend angularly with respect to each other to provide the generally wedge shape of the bellows.

The bottle embodiment 20*d* shown in FIGS. 11–13 has its bellows 36 constructed with folds 44 that are rectangular, preferably generally square, and that extend angularly with respect to each other to provide the generally wedge shape of the bellows. With this embodiment, the generally wedge-shaped bellows 36 has a curved wall 36 at its location of truncation as shown in FIGS. 11 and 13 and its folds 44 extend therefrom angularly with respect to each other. It should also be appreciated that the bottle 20*d* with the rectangular folds 44 while illustrated with the bellows 36 truncated and with the frangible connection 40 like the embodiment of FIGS. 1–6 can also be constructed as herein described in connection with the other embodiments.

While the best modes for carrying out the invention have been described in detail, those familiar with the art to which this invention relates will recognize various alternative designs and embodiments for carrying out the invention as described by the following claims.

What is claimed is:

1. A plastic blow molded bottle comprising:

a vertically extending body portion for holding contents received by the bottle;

a lower closure end including a lower wall that closes the lower extremity of the body portion; and an upper dispensing end including an upper wall that generally closes the upper extremity of the body portion, a generally wedge-shaped bellows mounted by the upper wall, a dispensing spout that is mounted by the generally wedge-shaped bellows on the upper wall, and a frangible connection that extends between the dispensing spout and the upper wall to position the dispensing spout generally vertical for filling of the bottle but is broken to allow tilting of the dispensed spout as the bellows contracts for more convenient dispensing of the bottle contents.

2. A plastic blow molded bottle as in claim 1 wherein the dispensing spout has a lower end that is entirely supported by the generally wedge-shaped bellows which is truncated and has folds that extend angularly with respect to each other away from the location of truncation.

3. A plastic blow molded bottle as in claim 1 wherein the dispensing spout has a lower end including a pivotal connection to the upper wall, and the generally wedge-shaped bellows including folds that extend angularly with respect to each other away from the pivotal connection.

4. A plastic blow molded bottle as in claim 1 wherein the frangible connection comprises a tab that extends between the dispensing spout and the upper wall and that is broken to release the dispensing spout for the tilting.

5. A plastic blow molded bottle as in claim 4 wherein the tab includes a reduced thickness portion that facilitates fracturing thereof to release the dispensing spout for the tilting.

6. A plastic blow molded bottle as in claim 5 wherein the reduced thickness portion connects the tab of the frangible connection to the dispensing spout.

7. A plastic blow molded bottle as in claim 5 wherein the reduced thickness portion connects the tab of the frangible connection to the upper wall.

8. A plastic blow molded bottle as in claim 5 wherein the reduced thickness portion connects the tab of the frangible connection to both the dispensing spout and the upper wall such that the tab can be easily broken away from the bottle to release the dispensing spout for tilting.

9. A plastic blow molded bottle as in claim 5 wherein the tab of the frangible connection includes an inner portion connected to both the upper wall and the dispensing spout, the tab of the frangible connection also including an outer edge portion, and the reduced thickness portion extending between the inner portion and the outer edge portion.

10. A plastic blow molded bottle as in claim 5 wherein the tab of the frangible connection includes a portion that remains secured to the bottle after fracturing thereof for tilting of the dispensing spout.

11. A plastic blow molded bottle as in claim 1 wherein the bellows has folds that are rounded and that extend angularly with respect to each other to provide the generally wedge shape of the bellows.

12. A plastic blow molded bottle as in claim 1 wherein the bellows has folds that are generally rectangular and that extend angularly with respect to each other to provide the generally wedge shape of the bellows.

13. A plastic blow molded bottle as in claim 1 wherein the upper dispensing end includes a wall portion that is inclined downwardly in an outward direction with respect to a central vertical axis of the bottle and that supports the generally wedge-shaped bellows, and the dispensing spout having a lower end that is inclined upwardly in an outward direction with respect to the central vertical axis of the bottle and that is supported by the upper extremity of the generally wedge-shaped bellows.

14. A plastic blow molded bottle as in claim 1 wherein the body portion, the lower closure end and the upper dispensing end have a horizontally elongated shape with opposite ends, and the generally wedge-shaped bellows being mounted on the upper wall of the horizontally elongated upper dispensing end at one end thereof with the dispensing spout supported above the bellows.

15. A plastic blow molded bottle as in claim 11 wherein the upper wall of the upper dispensing end has opposite ends inclined downwardly away from each other in a generally gable shape, the lower extremity of the generally wedge-shaped bellows being mounted on one of the inclined ends of the upper wall, and the dispensing spout having a lower end that is inclined upwardly in an outward direction with respect to the peak of the gable shape of the upper wall and that is supported by the upper extremity of the generally wedge-shaped bellows.

16. A plastic blow molded bottle comprising:

a vertically extending body portion for holding contents received by the bottle;

a lower closure end including a lower wall that closes the lower extremity of the body portion; and an upper dispensing end including an upper wall that generally closes the upper extremity of the body portion, a generally wedge-shaped bellows mounted by the upper wall, a dispensing spout mounted by the generally wedge-shaped bellows on the upper wall, a frangible connection including a tab that extends between the dispensing spout and the upper wall to position the dispensing spout generally vertical for filling of the bottle, and the tab having a reduced thickness portion that is broken to allow the dispensed spout to be tilted as the bellows contracts to allow more convenient dispensing of the bottle contents.

17. A plastic blow molded bottle comprising:

a vertically extending body portion for holding contents received by the bottle;

a lower closure end including a lower wall that closes the lower extremity of the body portion; and an upper dispensing end including an upper wall that generally closes the upper extremity of the body portion, a generally wedge-shaped bellows mounted by the upper wall, a dispensing spout mounted by the generally wedge-shaped bellows on the upper wall, a frangible connection including a tab that extends between the dispensing spout and the upper wall to position the dispensing spout generally vertical for filling of the bottle, and the tab having a reduced thickness portion that is connected to the dispensing spout and to the upper wall to allow the tab to be broken away from the bottle such that the dispensed spout can be tilted as the bellows contracts to allow more convenient dispensing of the bottle contents.

18. A plastic blow molded bottle comprising:

a vertically extending body portion having a horizontally elongated shape for holding contents received by the bottle;

a horizontally elongated lower closure end including a lower wall that closes the lower extremity of the body portion; and a horizontally elongated upper dispensing end including an upper wall that generally closes the upper extremity of the body portion and has opposite ends, a generally wedge-shaped bellows mounted by one end of the upper wall, a dispensing spout mounted by the generally wedge-shaped bellows on the upper wall, a frangible connection including a tab that extends between the dispensing spout and the upper wall to position the dispensing spout generally vertical for filling of the bottle, and the tab having a reduced thickness portion that is connected to the dispensing spout and to the upper wall to allow the tab to be broken away from the bottle such that the dispensed spout can be tilted as the bellows contracts to allow more convenient dispensing of the bottle contents.

19. A plastic blow molded bottle comprising:

a vertically extending body portion having a horizontally elongated shape for holding contents received by the bottle;

a horizontally elongated lower closure end including a lower wall that closes the lower extremity of the body portion; and a horizontally elongated upper dispensing end including an upper wall that generally closes the upper extremity of the body portion and has opposite ends that are inclined downwardly away from each other in a generally gable shape, a generally wedge-shaped bellows having a lower extremity mounted by one inclined end of the upper wall, a dispensing spout having a lower end that is inclined upwardly in an outward direction with respect to the peak of the gable shape of the upper wall and that is mounted by the upper extremity of the generally wedge-shaped bellows on the upper wall, a frangible connection including a tab that extends between the dispensing spout and the upper wall to position the dispensing spout generally vertical for filling of the bottle, and the tab having a reduced thickness portion that is connected to the dispensing spout and to the upper wall to allow the tab to be broken away from the bottle such that the dispensed spout can be tilted as the bellows contracts to allow more convenient dispensing of the bottle contents.

20. A plastic blow molded bottle comprising:

a vertically extending body portion for holding contents received by the bottle;

a lower closure end including a lower wall that closes the lower extremity of the body portion; and an upper dispensing end including an upper wall that generally closes the upper extremity of the body portion and has an inclined wall portion that extends downwardly in an outward direction with respect to a central vertical axis of the bottle, a generally wedge-shaped bellows having a lower extremity mounted by the inclined wall portion of the upper wall, a dispensing spout having a lower end that is inclined upwardly in an outward direction with respect to the central vertical axis of the bottle and that is mounted by the upper extremity of the generally wedge-shaped bellows on the upper wall, a frangible connection including a tab that extends between the dispensing spout and the upper wall to position the dispensing spout generally vertical for filling of the bottle, and the tab having reduced thickness connections to the upper wall and the dispensing spout so as to be capable of being broken away from the bottle to allow the dispensed spout to be tilted as the bellows contracts to allow more convenient dispensing of the bottle contents.

* * * * *

UNITED STATES PATENT AND TRADEMARK OFFICE

CERTIFICATE OF CORRECTION

PATENT NO. : 5,503,308

DATED : April 2, 1996

INVENTOR(S) : William C. Young, et al.

It is certified that error appears in the above-indentified patent and that said Letters Patent is hereby corrected as shown below:

Column 1, line 46 line 14), after "rather" insert --than--, and change "intended" to --indicated--.

Column 4, line 19 line 10), change "bottle" to --bottles--.

Column 4, line 30, line 20), change "potion" to --portion--.

Column 7, line 21, line 29), change "36" (second occurrence) to --36'--.

Column 8, line 47, claim 15 line 2, claim 16), change "11" to --14--.

Signed and Sealed this

Twenty-ninth Day of April, 1997

*Attest:*

*Attesting Officer*

BRUCE LEHMAN

*Commissioner of Patents and Trademarks*